US011421944B2

(12) United States Patent
Durbecq

(10) Patent No.: US 11,421,944 B2
(45) Date of Patent: Aug. 23, 2022

(54) FLAT TUBE FOR A HEAT EXCHANGER AND A HEAT EXCHANGER THAT IS MORE RESISTANT TO DEBRIS

(71) Applicant: Valeo Systemes Thermiques, Le Mesnil-Saint-Denis (FR)

(72) Inventor: Gaël Durbecq, Reims (FR)

(73) Assignee: Valeo Systemes Thermiques, Le Mesnil Saint-Denis (FR)

( * ) Notice: Subject to any disclaimer, the term of this patent is extended or adjusted under 35 U.S.C. 154(b) by 224 days.

(21) Appl. No.: 16/610,369

(22) PCT Filed: Apr. 30, 2018

(86) PCT No.: PCT/EP2018/061049
§ 371 (c)(1),
(2) Date: Nov. 1, 2019

(87) PCT Pub. No.: WO2018/202630
PCT Pub. Date: Nov. 8, 2018

(65) Prior Publication Data

US 2020/0072558 A1 Mar. 5, 2020

(30) Foreign Application Priority Data

May 2, 2017 (EP) ..... 17169134
May 2, 2017 (EP) ..... 17169138

(51) Int. Cl.
*F28F 1/04* (2006.01)
*F28F 1/40* (2006.01)
(Continued)

(52) U.S. Cl.
CPC ..... *F28F 1/04* (2013.01); *F28F 1/40* (2013.01); *B21C 37/0807* (2013.01); *B21C 37/22* (2013.01); *F28D 1/0391* (2013.01)

(58) Field of Classification Search
CPC .. F28F 1/40; F28F 1/04; F28D 1/0391; B21C 37/22; B21C 37/0807
See application file for complete search history.

(56) References Cited

U.S. PATENT DOCUMENTS 2,912,749 A * 11/1959 Huggins ..... F28D 1/0391 29/890.039
6,213,158 B1 * 4/2001 Rhodes ..... F28F 13/12 138/177

(Continued)

FOREIGN PATENT DOCUMENTS

CN 101450355 A 6/2009
CN 106556279 A 4/2017

(Continued)

OTHER PUBLICATIONS

First Office Action in corresponding Chinese Application No. 201880029472.6, dated Nov. 3, 2020 (12 pages).

(Continued)

*Primary Examiner* — Paul Alvare
(74) *Attorney, Agent, or Firm* — Osha Bergman Watanabe & Burton LLP

(57) ABSTRACT

A flat tube for a heat exchanger, with two open ends defining its longitudinal direction, may include a first wall and a second wall which are flat and parallel to each other, thereby delimiting the inner space of the tube. The flat tube may include an inner fin located between the first and the second walls. One of the lateral sides of the first wall may include a main fold running along the longitudinal direction, wherein arms of the main fold form a slit facing the inner space of the tube, and the lateral side of the second wall is bent to cover the main fold.

14 Claims, 2 Drawing Sheets

Figure 1:
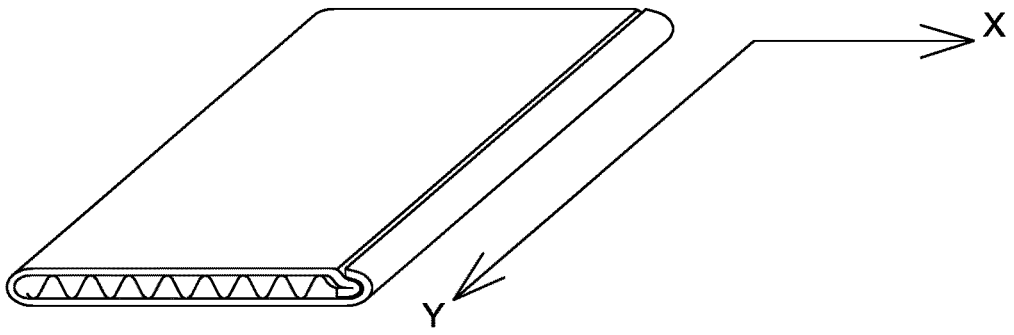

(51) Int. Cl.

| | |
|---|---|
| ***F28D 1/03*** | (2006.01) |
| *B21C 37/22* | (2006.01) |
| *B21C 37/08* | (2006.01) |

(56) References Cited

U.S. PATENT DOCUMENTS

| | | | | |
|---|---|---|---|---|
| 6,666,265 | B1 * | 12/2003 | Kato | B21C 37/104 165/177 |
| 7,921,559 | B2 * | 4/2011 | Zobel | B21C 37/158 29/890.053 |
| 8,091,621 | B2 * | 1/2012 | Zobel | B21C 37/157 165/177 |
| 8,438,728 | B2 * | 5/2013 | Zobel | B21C 37/157 29/890.053 |
| 10,267,572 | B2 * | 4/2019 | Kaestle | F28F 1/12 |
| 10,677,537 | B2 * | 6/2020 | Kitou | F28D 1/05366 |
| 2005/0173100 | A1 * | 8/2005 | Takai | F28F 21/084 165/149 |
| 2007/0119581 | A1 * | 5/2007 | Kato | F28D 1/0391 165/177 |
| 2009/0019695 | A1 | 1/2009 | Zobel et al. | |
| 2012/0031602 | A1 | 2/2012 | Eisele | |

FOREIGN PATENT DOCUMENTS

| | | | |
|---|---|---|---|
| DE | 197 53 724 | A1 | 6/1999 |
| DE | 10 2006 016711 | A1 | 10/2007 |
| DE | 10 2007 004993 | A1 | 8/2008 |
| EP | 0283937 | A1 | 9/1988 |
| EP | 1 702 710 | A1 | 9/2006 |
| JP | H07-158999 | A | 6/1995 |
| WO | 01/49443 | A1 | 7/2001 |
| WO | 2013150766 | A1 | 10/2013 |

OTHER PUBLICATIONS

International Search Report and Written Opinion in corresponding International Application No. PCT/EP2018/061049, dated Jul. 25, 2018 (9 pages).

Communication from the Examining Division in corresponding European Application No. 17 169 134.8, dated Feb. 17, 2022 (5 pages).

* cited by examiner

FLAT TUBE FOR A HEAT EXCHANGER AND A HEAT EXCHANGER THAT IS MORE RESISTANT TO DEBRIS

The object of the invention is a flat tube for a heat exchanger and a heat exchanger.

There are known in the art tubes for heat exchangers, for example condensers, which are used to guide a fluid and enable its cooling.

Such heat exchangers can be implemented in vehicles, e.g. cars. These vehicles are directly exposed to debris such as stones or other objects, either when they are moving or when they are stationary. The stones can travel at significant speed and can impact the heat exchanger, which in most cases is situated in front of the car and is at least partly exposed or can be reached after passing through the radiator grill. Impact of such objects can cause damage to the elements of the heat exchanger, which may lead to leaks of the fluid flowing through them and/or to deterioration of their performance.

It is thus desirable to provide an improved tube for a heat exchanger, which would be more resistant to debris and consequently which would reduce a chance of leakage and/or decrease in performance.

The object of invention is a flat tube for a heat exchanger, with two open ends defining its longitudinal direction, comprising a first wall and a second wall which are flat and parallel to each other, thereby delimiting the inner space of the tube, and further comprising an inner fin located between the first and the second walls, wherein one of the lateral sides of the first wall comprises a main fold running along the longitudinal direction, wherein arms of the main fold form a slit facing the inner space of the tube, and the lateral side of the second wall is bent to cover the main fold.

Preferably, the lateral side of the fin adjacent to the main fold leans on the slit of the main fold.

Preferably, the lateral side of the fin adjacent to the main fold is placed inside the slit of the main fold.

Preferably, the lateral side of the fin adjacent to the main fold, placed inside the slit, is a single layer of that fin.

Preferably, the lateral side of the fin adjacent to the main fold, placed inside the slit, is compressed by the arms of the main fold.

Preferably, plane of the slit is parallel to planes of the first wall and the second wall.

Preferably, the slit is located in the middle of the distance between the first wall and the second wall.

Preferably, the slit of the main fold is displaced towards the plane of the first wall or the second wall.

Preferably, the lateral side of the first wall comprises a secondary fold, adjacent to one of the arms of the main fold.

Preferably, the lateral side of the first wall comprises two secondary folds, adjacent to both arms of the main fold.

Preferably, the lateral side of the second wall, bent over the main fold, is folded along this main fold.

Preferably, the main fold is a double-walled nose, the walls of said double-walled nose contacting each other along a contact section, wherein walls of the nose have equal lateral length.

Preferably, the contact section of the walls of the double-walled nose runs in parallel to planes of the first wall and the second wall.

Preferably, the lateral side of the second wall, bent over the double walled nose, is bent so that it contacts both walls of the double walled nose.

Preferably, the lateral side of the second wall, bent over the double walled nose, is also double walled.

Preferably, the lateral side of the second wall, bent over the double walled nose, consists of one layer.

Preferably, the thickness of the reinforced tube nose in lateral direction is in the range [0.5×tube height; 1.5×tube height] and preferentially in the range [0.5×tube height; tube height].

Another object of the invention is a heat exchanger comprising a tube as described.

Figure 2:
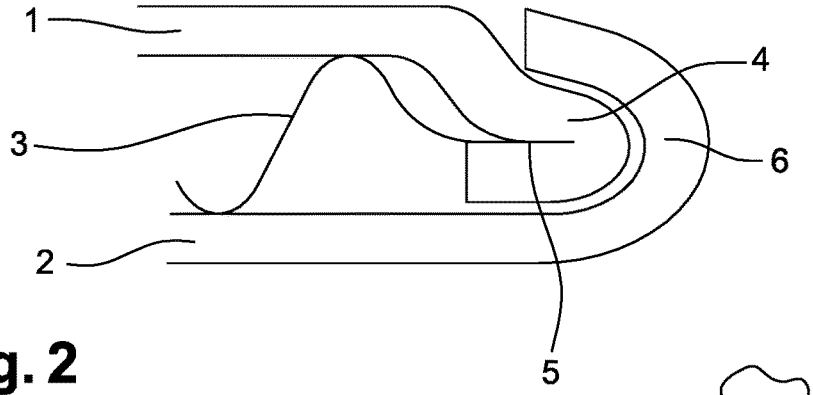
Figure 3:
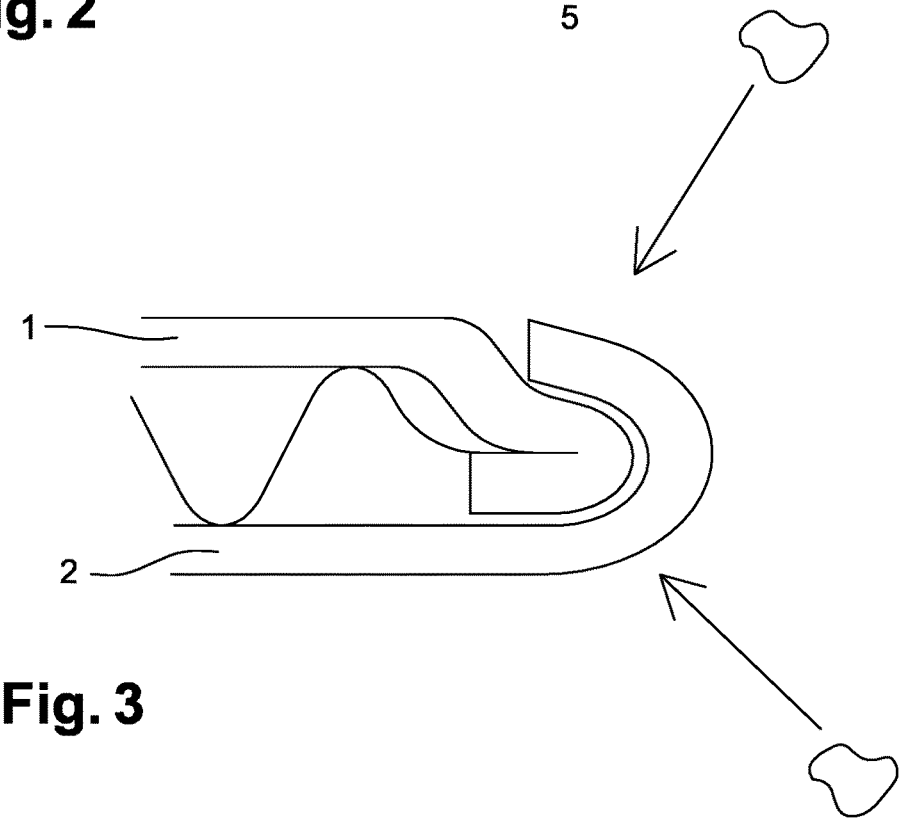

The object of the invention has been presented by means of a drawing, in which:

FIG. 1 shows a general shape of a flat tube,

FIG. 2 presents a tube according to the first embodiment,

FIG. 3 presents exemplary path of stones impacting the tube.

Figure 4:
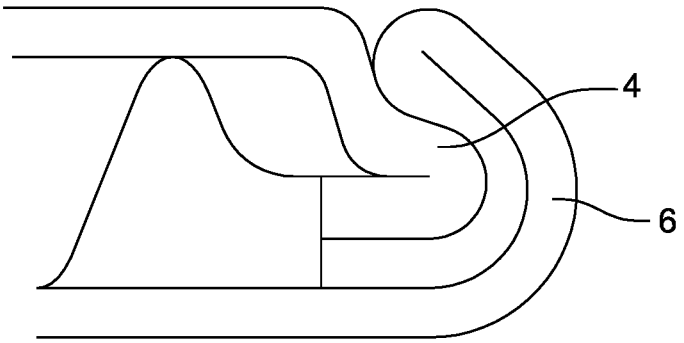
Figure 5:
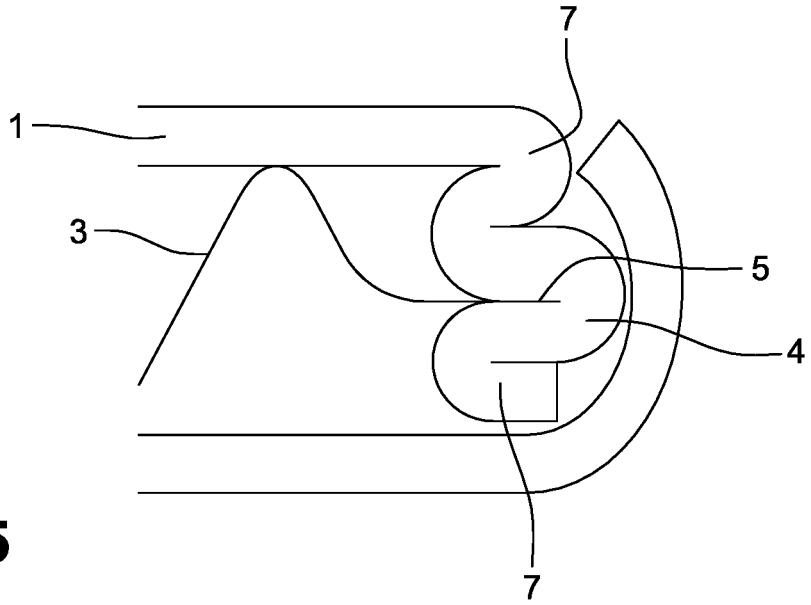
Figure 6:
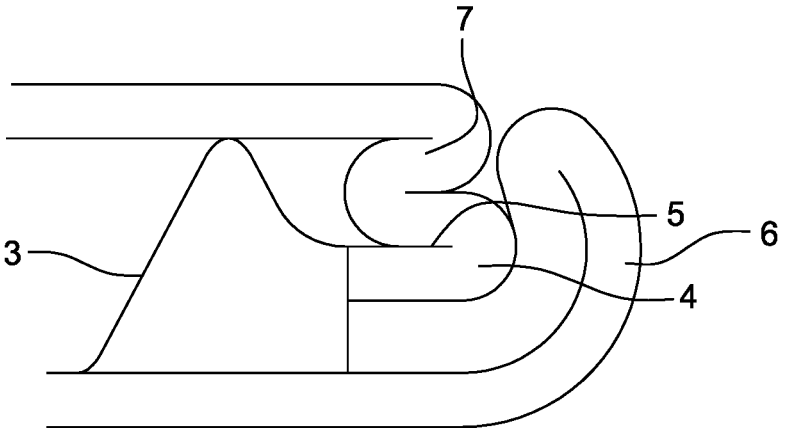

FIG. 4 presents a tube according to the second embodiment,

FIG. 5 presents a tube according to the third embodiment,

FIG. 6 presents a tube according to the fourth embodiment.

FIG. 1 presents a general shape of a flat tube which is an object of the invention. The invention specifically regards tube nose, which is depicted in detail in the following figures. The tube is defined by reference to general directions: longitudinal and lateral. These are presented in FIG. 1, as y axis and x axis, respectively. The reinforced tube nose can be located on the front area of the heat exchanger (e.g. condenser), e.g. facing the road.

FIG. 2 shows a flat tube according to the invention in the first embodiment. The tube comprises a first wall 1 and a second wall 2, which are flat and parallel to each other. Together they delimit the inner space of the tube. The tube has two opened ends, which define a longitudinal direction of the tube and a general path for the fluid flow. The tube can further comprise an inner fin 3. The fin can be a corrugated fin having a wave-like form. Other shapes of fins are also envisaged. One of the lateral sides of the first wall 1 is folded to form a main fold 4 along the longitudinal direction. The main fold 4 comprises a slit 5 facing the delimited space inside the flat tube. This slit 5 is constituted by two substantially parallel arms of the main fold 4. The term "slit" is used here to describe a very narrow gap of possibly minimal or no play, as opposed to a channel of height larger than a thickness of a single layer of the fin 3. The lateral side end of the fin 3, adjacent to the main fold 4, can be leaned on the slit 5 of the main fold 4. This may facilitate positioning of the fin 3 in the tube during manufacturing. Further, the lateral side end of the fin 3, adjacent to the main fold 4, can be placed inside the slit 5 of the main fold 4. In this way, the fin 3 can be attached to the tube by being compressed by arms of said main fold 4. By compression it is meant that the fin 3 inside the slit 5 is contacted and pressed by both arms of the main fold 4 substantially along all their lengths, or only partially. Fragment of the fin 3 inside the slit 5 enhances resistance of the tube nose. Moreover, such attachment of the fin 3 inside the main fold 4 improves the whole arrangement of the flat tube against shocks from impacts, improving its mechanical integrity, e.g. by preventing movement of the fin 3 inside the tube upon strong hit.

The main fold 4 can be formed in the middle between the first wall 1 and the second wall 2, so that the slit 5 will also be in the middle between the first wall 1 and the second wall 2. This facilitates a substantially identical resistance from both sides of the tube, i.e. the resistance will be improved substantially identically with respect to stones impacting from the side of the first wall 1 and from the side of the second wall 2, as illustrated in FIG. 3.

It is also envisaged to position the main fold 4 (and consequently the slit 5) at another distance with respect to the first or second walls. For example, the main fold 4 located closer to the first wall 1 will contribute more to its resistance from the side of said first wall 1. Similarly, the main fold 4 located nearer the second wall 2 will contribute more to its resistance from the side of said second wall 2. In other words, the slit 5 (plane of the slit) of the main fold 4 can be displaced towards the plane of the first or second wall 1, 2. By term "plane" it is meant a general plane of the flat portion. Such feature may be advantageous in case of an unorthodox arrangement of the tubes, e.g. oriented an angle with respect to driving direction or at angle corresponding to statistically more probable angle of stone impact.

Preferably, the lateral side of the fin 3 adjacent to the main fold 4, placed inside the slit 5, is a single layer of that fin 3. This simplifies the manufacturing process and saves material.

Preferably, the slit 5 is substantially parallel to the first and second walls, and to the general lateral direction of the fin 3. In other words, plane of the slit 5 is parallel to planes of the first wall 1 and the second wall 2. Consequently, the fragment of the fin 3 placed inside the slit 5 effectively enhances the rigidity of the tube at minimal cost of both production and material. At the same time, such orientation ensures a substantially identical resistance from both sides of the tube, as illustrated in FIG. 3.

The respective end of the second wall 2 is bent around the main fold 4 so that it encompasses it. In other words, the lateral end of the second wall 2 forms a side wall 6, which covers the main fold 4 of the first wall 1. This further strengthens the tube. At the same time it protects the main fold 4 and enables the tube to have a unitary, unobtrusive shape.

FIG. 4 shows the second embodiment of the invention. In this embodiment, the side wall 6 also comprises a fold. In other words, the side wall 6 can be double-walled. This fold extends along the circumference of the main fold 4. This provides a more resistant side wall 6, because it is layered and consequently harder to damage, bend etc.

FIG. 5 shows the third embodiment of the invention. In this embodiment, the lateral side of the first wall 1 further comprises secondary folds 7, before and after (above and below) the main fold 4 with slit 5. These secondary folds 7 improve resistance of the tube at lateral side. They also allow to impart more pressure onto the lateral end of the fin 3 inserted into the slit 5, e.g. by further compression of the main fold 4, thereby improving connection of the fin 3 to the flat tube. Selecting the number of the secondary folds 7 enables for easy control of the general height of the flat tube, as their count directly translates into combined thicknesses.

FIG. 6 shows the fourth embodiment of the invention. This embodiment comprises a secondary fold 7, before (above) the main fold 4 with slit 5. This secondary fold 7 improves resistance of the tube at lateral side. It also allows to impart more pressure onto the lateral end of the fin 4 inserted into the slit 5, e.g. by further compression of the main fold 4, thereby improving connection of the fin 4 to the flat tube. In this embodiment, the side wall 6 also comprises a fold. This fold extends along the circumference of the main fold 4. This provides a more resistant side wall 6, because it is layered and consequently harder to damage, bend etc.

The embodiments present a slit 5 of certain lateral length. The lateral length of slit 5 of the main fold 4 is dependent on the lateral length of the arms of the main fold 4. The longer the slit 5, the more resistant the nose of the tube, as the thicknesses of the main fold 4 and the side of the second wall 6 compound at longer distance. As the side of the fin 4 runs deeper in the slit 5, the resistance is further improved.

The main fold 4 may form a double-walled nose along the longitudinal direction. In such case, the slit 5 can be a contact section facing the delimited space inside the flat tube. This contact section is constituted by two substantially parallel walls of the double-walled nose.

The tube according to the invention may be a tube made of a single sheet of material. It can also be made of two sheets of material, constituting for example separately its first and second walls. Consequently, the disclosed nose of the tube can be present on one lateral side of the tube, or both lateral sides of the tube. The thickness of the reinforced tube nose can be in the range [0.5×tube height; 1.5×tube height] and preferentially in the range [0.5×tube height; tube height]. The tube height here is defined along an axis perpendicular to longitudinal and lateral directions.

These tubes can be produced by roll forming, similar to the process for currently known tubes with bends or folds.

The invention claimed is:

1. A flat tube for a heat exchanger, with two open ends defining a longitudinal direction of the flat tube, comprising:

a first wall and a second wall which are flat and parallel to each other, thereby delimiting the inner space of the tube; and an inner fin located between the first and the second walls, wherein one lateral side of the first wall comprises a main fold running along the longitudinal direction, wherein arms of the main fold form a slit facing the inner space of the tube, and a lateral side of the second wall is bent to cover the main fold, wherein a lateral side of the fin adjacent to the main fold is placed inside the slit of the main fold, and wherein both sides of the fin are compressed by the arms of the main fold.

2. The tube according to claim 1, wherein the lateral side of the fin adjacent to the main fold, placed inside the slit, is a single layer of that fin.

3. The tube according to claim 1, wherein plane of the slit is parallel to planes of the first wall and the second wall.

4. The tube according to claim 1, wherein the slit is located in the middle of the distance between the first wall and the second wall.

5. The tube according to claim 1, wherein the slit of the main fold is displaced towards the plane of the first wall or the second wall.

6. The tube according to claim 1, wherein the lateral side of the first wall comprises a secondary fold, adjacent to one of the arms of the main fold.

7. The tube according to claim 1, wherein the lateral side of the first wall comprises two secondary folds, adjacent to both arms of the main fold.

8. The tube according to claim 1, wherein the lateral side of the second wall, bent over the main fold, is folded along this main fold.

9. The tube according to claim 1, wherein the main fold is a double-walled nose, the walls of said double-walled nose contacting each other along a contact section, wherein walls of the nose have equal lateral length.

10. The tube according to claim 9, wherein the contact section of the walls of the double-walled nose runs in parallel to planes of the first wall and the second wall.

11. The tube according to claim 10, wherein the lateral side of the second wall, bent over the double: walled nose, is bent so that it contacts both walls of the double walled nose.

12. The tube according to claim 1, wherein the lateral side of the second wall, bent over the double walled nose, is also double walled.

13. The tube according to claim 9, wherein the lateral side of the second wall, bent over the double: walled nose, consists of one layer.

14. The tube according to claim 1, wherein the thickness of the reinforced tube nose in a lateral direction is in the range 0.5×tube height to 1.5× tube height.

* * * * *